US012304702B2

(12) United States Patent
Menozzi et al.

(10) Patent No.: US 12,304,702 B2
(45) Date of Patent: May 20, 2025

(54) LID ASSEMBLY FOR A CONTAINER, CONTAINER HAVING A LID ASSEMBLY AND METHOD OF COUPLING A LID ASSEMBLY TO A SPOUT

(71) Applicant: TETRA LAVAL HOLDINGS & FINANCE S.A., Pully (CH)

(72) Inventors: Stefano Menozzi, Parma (IT); Paolo Zanon, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/907,170

(22) PCT Filed: Apr. 1, 2021

(86) PCT No.: PCT/EP2021/058616
§ 371 (c)(1),
(2) Date: Sep. 23, 2022

(87) PCT Pub. No.: WO2021/204668
PCT Pub. Date: Oct. 14, 2021

(65) Prior Publication Data

US 2023/0115201 A1 Apr. 13, 2023

(30) Foreign Application Priority Data

Apr. 9, 2020 (EP) ..... 20168898

(51) Int. Cl.
*B65D 47/08* (2006.01)
*B65D 5/74* (2006.01)

(52) U.S. Cl.
CPC ..... *B65D 47/0838* (2013.01); *B65D 5/746* (2013.01); *B65D 2251/02* (2013.01); *B65D 2251/04* (2013.01)

(58) Field of Classification Search
CPC .... B65D 2251/0025; B65D 2251/0093; B65D 2251/0015; B65D 2251/023;
(Continued)

(56) References Cited

U.S. PATENT DOCUMENTS 3,160,327 A * 12/1964 Porcelli ..... B65D 47/103 220/837
3,458,080 A * 7/1969 Jeremiah ..... B65D 47/103 222/541.9
(Continued)

FOREIGN PATENT DOCUMENTS

JP 2004067205 A 3/2004
JP 2006151487 A 6/2006
(Continued)

OTHER PUBLICATIONS

U.S. Appl. No. 17/913,918, filed Sep. 23, 2022, Davide Morciano et al.
(Continued)

*Primary Examiner* — Steven A. Reynolds
*Assistant Examiner* — Prince Pal
(74) *Attorney, Agent, or Firm* — BUCHANAN INGERSOLL & ROONEY PC

(57) ABSTRACT

There is described a lid assembly for a container having a spout. The lid assembly comprises at least a coupling ring configured to be arranged around at least a portion of the spout; a lid configured to selectively cover a pouring outlet of the spout; and a tethering element tethering the lid to the coupling ring. The lid comprises at least a first gripping wall and at least a second gripping wall defining respective engagement surfaces configured to be engaged by at least a portion of an application device and/or to support gripping and/or alignment and/or rotation of the lid during a coupling of the lid assembly to the spout and being arranged on
(Continued)

opposing portions of the lid. Each one of the first gripping wall and the second gripping wall lies on a respective plane distinct from the other one.

16 Claims, 3 Drawing Sheets

(58) Field of Classification Search
CPC .... B65D 51/228; B65D 51/20; B65D 47/103; B65D 47/0875; B65D 47/123; B65D 5/476; B65D 5/747; B65D 5/749
USPC ..... 220/270, 258.2, 541.9, 541.5, 562, 220/153.07, 528
See application file for complete search history.

(56) References Cited

U.S. PATENT DOCUMENTS 4,344,545 A * 8/1982 Aschberger ..... B65D 47/141 222/153.07
4,353,483 A * 10/1982 Pehr ..... B65D 83/228 220/915
4,496,069 A * 1/1985 Winkless ..... B65D 55/02 220/270
4,795,065 A * 1/1989 Ashizawa ..... B65D 47/0838 220/832
4,948,015 A * 8/1990 Kawajiri ..... B65D 5/749 222/541.9
4,964,562 A * 10/1990 Gordon ..... B29C 65/08 220/288
5,101,999 A * 4/1992 Robichaud ..... B65D 5/748 220/267
5,108,029 A * 4/1992 Abrams ..... B65D 5/746 220/837
5,133,486 A * 7/1992 Moore ..... B65D 47/103 229/125.05
5,199,635 A * 4/1993 Abrams ..... B65D 5/746 229/125.09
5,303,837 A * 4/1994 Adams ..... B65D 47/121 220/276
5,397,013 A * 3/1995 Adams ..... B65D 41/3409 222/541.9
5,464,112 A * 11/1995 Guillot ..... B65D 47/0833 220/257.1
5,509,585 A * 4/1996 Mock ..... B65D 5/746 222/566
5,678,719 A * 10/1997 Adams ..... B29C 45/006 215/253
5,725,121 A * 3/1998 Gianpaolo ..... B65D 5/746 220/784
5,735,418 A * 4/1998 Erb ..... B65D 47/0819 220/254.5
5,735,426 A * 4/1998 Babcock ..... B65D 5/746 215/354
5,765,747 A * 6/1998 Lawson ..... B65D 5/746 222/541.9
5,799,840 A * 9/1998 Mogard ..... B65D 47/0842 222/541.9
5,839,627 A * 11/1998 Hicks ..... B65D 5/701 222/541.9
5,934,496 A * 8/1999 Mogard ..... B65D 47/103 220/837
D414,698 S * 10/1999 Mogard ..... D9/449
6,003,712 A * 12/1999 Mogard ..... B65D 47/0842 222/541.9
6,125,610 A * 10/2000 Mogard ..... B65B 61/186 493/379
6,131,806 A * 10/2000 Hess, III ..... B65D 75/5822 229/125.14
6,164,503 A * 12/2000 Forsyth ..... B65D 51/20 222/153.05
6,179,147 B1 * 1/2001 Mogard ..... B65D 47/103 222/541.9
6,237,818 B1 * 5/2001 Kline ..... B65D 25/44 222/541.9
6,364,164 B1 * 4/2002 Troiano ..... B65D 5/748 220/297
6,402,019 B1 * 6/2002 Casale ..... B65B 61/186 53/329.2
6,779,672 B2 * 8/2004 Kano ..... B65D 41/0421 215/354
6,845,902 B1 * 1/2005 Bomer ..... B65D 5/749 229/125.09
6,851,586 B2 * 2/2005 Odet ..... B65D 47/128 222/541.9
6,889,867 B1 * 5/2005 Smith ..... B65D 47/0838
8,215,506 B2 * 7/2012 Soehnlen ..... B65D 47/0842 215/235
9,278,784 B2 * 3/2016 Wood ..... B67B 6/00
9,327,862 B2 * 5/2016 Barbieri ..... B65D 5/4266
9,487,324 B2 * 11/2016 Benkö ..... B65D 5/748
9,598,209 B1 * 3/2017 Maldonado ..... B65D 47/122
9,884,706 B1 2/2018 Skillin et al.
10,046,892 B2 * 8/2018 Fang ..... F16L 35/00
10,138,043 B2 * 11/2018 Mazurkiewicz ... B65D 47/0857
10,173,816 B2 * 1/2019 Danks ..... B65D 5/746
10,196,178 B2 * 2/2019 Martini ..... B65D 41/0485
10,293,972 B2 * 5/2019 Golfieri ..... B65D 17/507
10,414,551 B2 * 9/2019 Martini ..... B65D 41/3428
11,040,806 B2 * 6/2021 Naumann ..... B65D 41/485
11,708,191 B2 * 7/2023 Silla ..... B65D 5/748 215/200
D996,212 S * 8/2023 Zanon ..... D9/449
D996,213 S * 8/2023 Zanon ..... D9/449
11,724,864 B2 * 8/2023 Corradi ..... B65D 5/749 220/277
11,772,860 B2 * 10/2023 Sterling ..... B65D 50/046 215/217
2003/0071042 A1 * 4/2003 Adams ..... B65D 47/103 222/541.9
2003/0136753 A1 * 7/2003 Biesecker ..... B65D 51/243 215/206
2003/0146271 A1 * 8/2003 Furini ..... B65B 9/2049 229/125.14
2003/0150191 A1 * 8/2003 Odet ..... B65D 45/30 220/257.1
2005/0205618 A1 * 9/2005 Mabee ..... B65D 47/0814 222/541.9
2005/0242112 A1 * 11/2005 Leuenberger ..... B65D 5/749 222/83
2006/0138137 A1 * 6/2006 Casale ..... B65D 5/749 220/259.3
2006/0186077 A1 * 8/2006 Robinson ..... B65D 47/0814 220/259.2
2008/0210707 A1 * 9/2008 Kitai ..... B65D 75/5877 222/129
2009/0134188 A1 * 5/2009 Wilson ..... B65D 47/40 222/546
2010/0140266 A1 * 6/2010 Lohrman ..... B65D 47/0838 220/254.3
2010/0140268 A1 * 6/2010 Lohrman ..... B65D 47/103 220/270
2010/0166923 A1 * 7/2010 Martini ..... B65D 5/747 426/115
2012/0318798 A1 * 12/2012 Domoy ..... B65D 43/169 220/258.2
2013/0146598 A1 * 6/2013 Salinas ..... B65D 5/746 220/268
2014/0069919 A1 * 3/2014 Robert ..... B29D 99/0096 220/258.2
2014/0263149 A1 * 9/2014 Berge ..... B65D 41/3423 215/44
2014/0291357 A1 * 10/2014 Antal, Sr. ..... B65D 25/52 222/454
2015/0353247 A1 * 12/2015 Isogai ..... B65D 47/106 215/252
2016/0325471 A1 * 11/2016 Martini ..... B29C 43/18
2016/0355306 A1 * 12/2016 Robin ..... B65D 17/4012
2017/0096273 A1 * 4/2017 Mazurkiewicz ... B65D 75/5883
2018/0086510 A1 * 3/2018 Berroa Garcia ..... B65D 47/08

(56) References Cited

U.S. PATENT DOCUMENTS

| | | | | |
|---|---|---|---|---|
| 2018/0327146 | A1* | 11/2018 | Martini | B65D 41/0485 |
| 2019/0344540 | A1* | 11/2019 | Cavanna | B29C 66/61 |
| 2021/0188479 | A1* | 6/2021 | Sorbara | B65D 5/746 |
| 2021/0237926 | A1* | 8/2021 | Barbieri | B65D 5/746 |
| 2021/0394953 | A1* | 12/2021 | Silla | B65D 51/222 |
| 2022/0119174 | A1* | 4/2022 | De Paola | B65D 51/222 |
| 2022/0177188 | A1* | 6/2022 | Minnette | B65D 55/16 |
| 2022/0185552 | A1* | 6/2022 | Corradi | B65D 41/485 |
| 2022/0371772 | A1* | 11/2022 | Wassum | B65D 5/748 |
| 2023/0115201 | A1* | 4/2023 | Menozzi | B65D 47/0838 220/200 |
| 2023/0121259 | A1* | 4/2023 | Morciano | B65D 5/746 220/258.1 |
| 2023/0124456 | A1* | 4/2023 | Morciano | B65D 51/228 222/556 |
| 2023/0127158 | A1* | 4/2023 | Morciano | B65D 5/746 222/556 |
| 2023/0137895 | A1* | 5/2023 | Morciano | B65D 51/228 222/528 |
| 2023/0182953 | A1* | 6/2023 | Palladino | B29C 45/14 220/268 |
| 2023/0182964 | A1* | 6/2023 | Palladino | B65D 5/746 222/528 |
| 2023/0182971 | A1* | 6/2023 | Filippini | B65D 47/141 222/556 |

FOREIGN PATENT DOCUMENTS

| | | | |
|---|---|---|---|
| JP | 2014091524 | A | 5/2014 |
| WO | 2007142429 | A1 | 12/2007 |
| WO | 2019113681 | A1 | 6/2019 |
| WO | 2020051597 | A1 | 3/2020 |

OTHER PUBLICATIONS

U.S. Appl. No. 17/914,059, filed Sep. 23, 2022, Davide Morciano et al.

U.S. Appl. No. 17/913,943, filed Sep. 23, 2022, Davide Morciano et al.

U.S. Appl. No. 17/914,025, filed Sep. 23, 2022, Davide Morciano et al.

U.S. Appl. No. 17/914,119, filed Sep. 23, 2022, Paolo Zanon et al.

International Search Report (PCT/ISA/210) and Written Opinion (PCT/ISA/237) mailed on Jun. 9, 2021, by the European Patent Office as the International Searching Authority for International Application No. PCT/EP2021/058616.

Office Action (Notice of Reasons for Refusal) issued on Dec. 10, 2024, in corresponding Japanese Patent Application No. 2022-549440 and English translation of the Office Action. (10 pages).

Office Action issued on Mar. 29, 2025, by the China National Intellectual Property Administration in corresponding Chinese Patent Application No. 202180009760.7. (9 pages).

* cited by examiner

LID ASSEMBLY FOR A CONTAINER, CONTAINER HAVING A LID ASSEMBLY AND METHOD OF COUPLING A LID ASSEMBLY TO A SPOUT

TECHNICAL FIELD

The present invention relates to a lid assembly for a container, in particular a sealed package, filled with a pourable product, even more particular filled with a pourable food product.

Advantageously, the present invention also relates to a container, in particular a sealed package, filled with a pourable product, even more particular filled with a pourable food product, and comprising a lid assembly, in particular coupled to a spout of the container.

Furthermore, the present invention also relates to a method of coupling a lid assembly to a spout.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages comprises a designated pour opening surface area having a separation membrane, which isolates the inside of the package from the outer environment and which is to be opened or to be removed or to be ruptured or to be cut or to be pierced prior to the first outpouring of the pourable product so as to allow for the outpouring of the pourable product. It is also known to arrange a spout having a pouring outlet on the package about the designated pour opening surface area, the spout being configured to allow for a controlled outpouring of the pourable product from the package.

It is further known to provide for a lid assembly, which is configured to selectively control the reversible closing and opening of the pouring outlet.

A typical lid assembly comprises a coupling ring, e.g. serving as a tamper evidence, and a lid. The coupling ring is arranged around the spout and the lid is configured to close the pouring outlet, when being arranged on the spout.

The lid assemblies are to be applied onto the spouts, which requires the operation of an application device. The application device needs to grip the lid assembly, to align and/or to orient the lid assembly with respect to the spout and/or package itself and to force the lid assembly onto the spout. The application device must operate such that the lid assembly and/or the package do not become damaged during the application of the lid assembly.

Even though application of the known lid assemblies to the known spouts works satisfyingly, there is a need felt in the sector to further improve the lid assemblies and/or the packages and/or the methods of assembling the lid assemblies to the spouts, in particular for improving the application of the lid assemblies onto the spouts.

DISCLOSURE OF INVENTION

It is therefore an object of the present invention to provide in a straightforward and low-cost manner an improved lid assembly for a container, in particular a sealed package, filled with a pourable product, even more particular filled with a pourable food product.

In particular, it is an object of the present invention to provide in a straightforward and low-cost manner an improved lid assembly for a container, in particular a sealed package, filled with a pourable product, even more particular filled with a pourable food product, which allows to facilitate and improve its application to respective spouts, in particular so as to further reduce the risk of damaging the lid assembly and/or the spout and/or the sealed package.

It is a further object of the present invention to provide in a straightforward and low-cost manner a container, in particular a finalized package, filled with a pourable product, in particular filled with a pourable food product, having a lid assembly, in particular the lid assembly being designed to improve and to facilitate its application to the respective spout, in particular so as to further reduce the risk of damaging the lid assembly and/or the spout and/or the sealed package.

It is a further object of the present invention to provide in a straightforward and low-cost manner a method of applying a lid assembly.

According to the present invention, there is provided a lid assembly according to claim 1.

Further advantageous embodiments of the lid assembly are specified in the respective dependent claims.

According to the present invention, there is also provided a container according to any one of claims 12 and 13.

According to the present invention there is also provided a method according to any one of claims 14 and 15.

BRIEF DESCRIPTION OF THE DRAWINGS

Three non-limiting embodiments of the present invention will be described by way of example with reference to the accompanying drawings, in which.

BEST MODES FOR CARRYING OUT THE INVENTION

Figure 1:
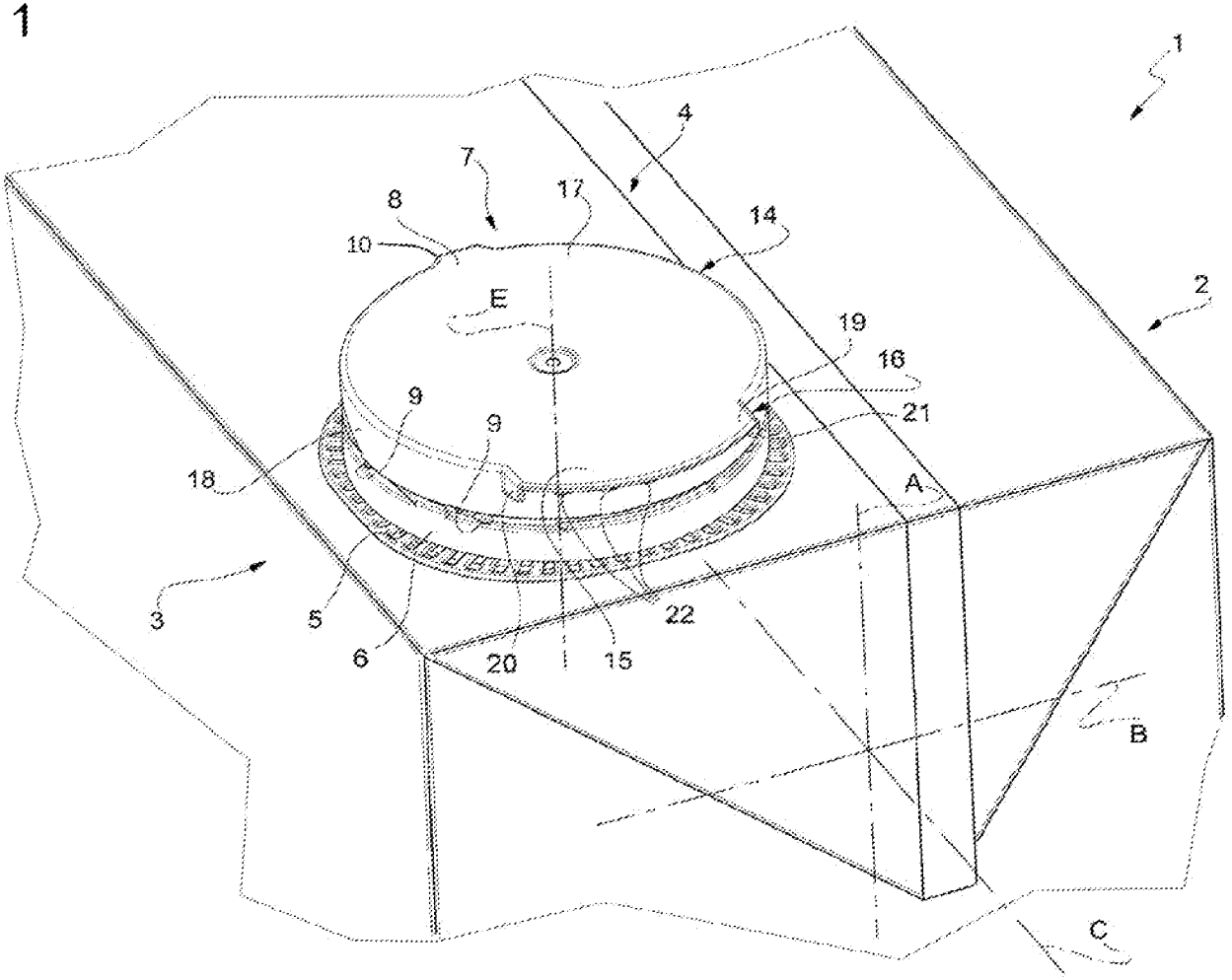
FIG. 1 is a schematic perspective view of a portion of a container having a lid assembly according to a first embodiment of the present invention, with parts removed for clarity.

Number 1 indicates as a whole a container, in particular a finalized package, comprising:

- a base container, in particular a sealed package 2, even more particular a sealed carton package, being filled with a pourable product, in particular a pourable food product, and in particular having a designated pour opening surface area (not shown and known as such);

a spout 3 (only partially shown to the extent necessary for the understanding of the present invention), in particular a plastic spout, fitted to the container, in particular to package 2 about the designated pour opening surface area, and having a pouring outlet; and a lid assembly 4 coupled and/or couplable to spout 3 and configured to selectively control the opening and closing of the pouring outlet 4.

According to some preferred non-limiting embodiments, package 2 is obtained from a packaging material, in particular being in the form of a web, and having a multilayer structure (not shown). The packaging material comprises at least one layer of fibrous material, such as e.g. a paper or cardboard, and at least two layers of heat-seal plastic material, e.g. polyethylene, interposing the layer of fibrous material in between one another. One of these two layers of heat-seal plastic material defining the inner face of package 2 contacting the pourable product.

Preferably but not necessarily, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the packaging material also comprises a further layer of heat-seal plastic material being interposed between the layer of gas- and light-barrier material and the layer of fibrous material.

According to a preferred non-limiting embodiment, spout(s) 3 is (are) applied to package(s) 2 prior, during or after the formation, filling and sealing of package(s) 2.

Alternatively, spout(s) 3 can be applied onto the packaging material prior to arranging the packaging material within or during advancement of the packaging material through a packaging machine for forming, filling and sealing packages 2 from the packaging material.

In particular, application of spout(s) 3 to the packaging material or to package 2 occurs by means of a molding process and/or adhesive bonding and/or ultrasonic bonding.

In particular, the combination of package 2 and/or of the packaging material with spout 3 defines a precursor of finalized package 1.

With particular reference to FIG. 1, package 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, package 2 is parallelepiped-shaped.

In particular, the designated pour opening surface area of package 2 is configured to be at least partially opened and/or ruptured and/or cut and/or pierced and/or removed so as to allow the out-pouring of the pourable product from package 2, in particular through spout 3, even more particular through the pouring outlet. Even more particular, the pour opening surface area is configured to allow the out-pouring of the pourable product after its loss of integrity and to protect the pourable product from the outer environment prior to its cutting and/or opening and/or rupturing and/or piercing and/or removal.

According to a preferred non-limiting embodiment, the pour opening surface area comprises a separation membrane (not shown and known as such) configured to be ruptured and/or (partially or fully) removed and/or opened and/or cut and/or pierced and/or removed. In particular, the separation membrane separates in the area of, in particular at, the pour opening surface area the inside of package 2 from the outer environment. Preferentially, the separation membrane comprises a gas- and light-barrier material, e.g. aluminum foil or ethylene vinyl alcohol (EVOH) film.

According to a preferred non-limiting embodiment, the separation membrane is defined by a portion of the packaging material, in particular a portion of the layers of the packaging material being different from the layer of fibrous material.

According to some preferred non-limiting embodiments, finalized package 1 also comprises an opening arrangement configured to rupture and/or open and/or cut and/or pierce and/or (partially or fully) remove the separation membrane. In particular, the opening arrangement is coupled to lid assembly 4 such that the opening arrangement is actuatable by means of lid assembly 4.

According to some non-limiting embodiments, the opening arrangement could comprise a cutter.

According to some alternative non-limiting embodiments, the opening arrangement could comprise a (polymer) covering layer covering, in particular being molded onto the separation membrane and/or partially defining the separation membrane, and a leg assembly molded and/or welded and/or fused to lid assembly 4 and to the covering layer.

With particular reference to FIG. 1, spout 3 comprises at least:

a base frame 5 coupling and/or configured to couple spout 3 to package, in particular at the pour opening surface area; and a collar being provided with at least the pouring outlet, configured to allow for an (controlled) outflow of the pourable product from finalized package 1 and/or package 2, in particular with the separation membrane having lost its integrity.

In particular, the collar extends along a longitudinal axis E, preferentially parallel to longitudinal axis A, and away and from base frame 5.

Preferentially, the collar and the pouring outlet present a (substantially) circular cross-sectional profile, in particular with respect to a cross-sectional plane perpendicular to longitudinal axis E.

Advantageously, lid assembly 4 comprises:

a coupling ring 6 configured to be arranged and/or being arranged, in particularly in a rotatable manner, around at least a portion of spout 3, in particular around at least a portion of the collar, in particular such that coupling ring 6 is inseparable from spout 3, in particular from the collar;

a lid 7 configured to selectively cover the pouring outlet, in particular for selectively opening and closing the pouring outlet; and a tethering element 10 tethering lid 7 to coupling ring 6.

Preferentially, lid 7 is hinged to coupling ring 6 by means of the tethering element and is adapted to angularly move around a hinge axis defined by the tethering element. In particular, the hinge axis being transversal to longitudinal axis E and/or axis A.

In particular, the tethering element is connected to a rear section 8 of lid 7.

According to some preferred non-limiting embodiments, lid 7 is controllable between at least:

a closed configuration (see FIGS. 1 and 3), in particular in which lid 7 is in a first angular position with respect to the hinge axis and, in which lid 7 is configured to cover and/or covers the pouring outlet, in particular for impeding an outflow of the pourable product from finalized package 1 and/or package 2; and an open configuration (not shown), in particular in which lid 7 is in a second angular position (distinct from the first angular positon) with respect to the hinge axis, and in which lid 7 is configured to be and/or is detached from the pouring outlet.

In particular, in use, control of lid 7 between the closed configuration and the open configuration requires the exertion of an opening force or closing force by means of a user so as to actuate the angular movement of lid 7 around the hinge axis.

In particular, during formation of finalized package 1, lid assembly 4 is coupled to and/or arranged on and/or associated to spout 3 such that lid 7 is in the closed configuration. Even more particular, finalized package 1 is provided to a user with lid 7 being in the closed configuration.

Preferentially, the opening arrangement is actuated during the first time of controlling lid 7 from the closed configuration to the open configuration so as to rupture and/or open and/or cut and/or pierce and/or/fully or partially) remove the separation membrane.

Preferentially, lid assembly 4 also comprises one or more rupturable coupling bridges 9 connecting coupling ring 6 to lid 7. In particular, coupling bridges 9 are configured to irreversibly rupture during the first time lid 7 is controlled from the closed configuration to the open configuration.

According to some preferred non-limiting embodiments, lid 7 comprises a main portion 14 carrying and/or having rear section 8 and a front section 15 opposite to rear section 8; and a lifting portion 16 protruding, in particular in a forward direction, from front section 15, and in particular away from rear section 8 and/or main portion 14.

It should be noted that the terms "front" and "rear" are to be understood in the context on how lid assembly 4 is arranged on spout 3 and, accordingly, on finalized package 1. In particular, the first time a user intends to control lid 7 from the closed configuration to the opening configuration the user faces front section 15, while rear section 8 is distanced from the user. In other words, during such a situation, front section 15 is interposed between the user and rear section 8.

However, within the context of the present description, it is important to note that rear section 8 is the section of lid 7 that is in direct contact with the tethering element, while front section 15 that is opposed to rear section 8.

In particular, lifting portion 16 is configured to be manipulated by a user in order to exert at least the opening force on lid 7 in order to control lid 7 from the first angular position to the second angular position around the hinge axis. In other words, lifting portion 16 defines a contact surface for the user. In particular, lifting portion 16 is designed to be contacted by a finger, such as the thumb, of the user.

Preferentially, lid 7, in particular main portion 14, comprises:

a top wall 17 configured to cover and/or covering pouring outlet with lid 7 being in the closed configuration; and a side wall 18 protruding from top wall 17 and configured to at least partially surround and/or at least partially surrounding the collar with lid 7 being controlled in the closed configuration.

In particular and with lid 7 being in the closed configuration top wall 17 is transversal, in particular perpendicular, to longitudinal axis E and side wall 18 is (substantially) parallel to longitudinal axis E.

In particular, lid 7, in particular main portion 14, is, even more particular top wall 17 and side wall 18 are, at least partially in contact with the collar when lid 7 is, in use, controlled in the closed configuration.

In particular, top wall 17 presents a circular shape and side wall 18 encloses a substantially cylindrical space.

Preferentially, lid 7 comprises an inner surface, in particular the inner surface being in contact with and/or facing the collar with lid 7 being controlled in the closed configuration.

Figure 2:
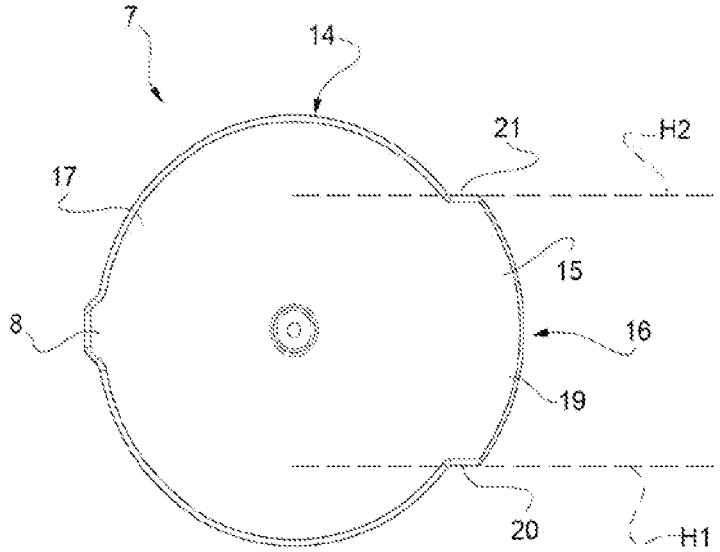
FIG. 2 is a top view of the lid assembly of FIG. 1, with parts removed for clarity.
Figure 3:
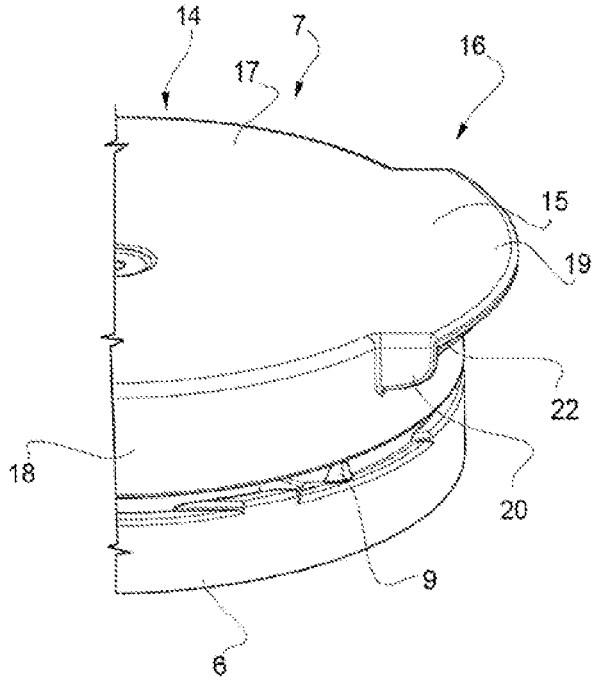
FIG. 3 is an enlarged perspective view of a detail of the lid assembly of FIG. 1, with parts removed for clarity.

With particular reference to FIGS. 1 to 3, lifting portion 16 is connected to main portion 14, in particular to top wall 17 and/or side wall 18.

Preferentially, lifting portion 16 comprises an elongated main wall 19, in particular extending away from main portion 14, in particular top wall 17 and/or side wall 18.

According to some possible non-limiting embodiments, elongated main wall 19 is (substantially) parallel to top wall 17 and/or is transversal, in particular perpendicular, to longitudinal axis E.

Alternatively, elongated main wall 19 could be transversal to top wall 17.

Preferentially, top wall 17 lies on a first extension plane and elongated main wall 19 lies on a second extension plane. According to possible non-limiting embodiments, first extension plane and second extension plane could coincide or be distinct from one another. In other words, first extension plane and second extension plane could be parallel to one another but being spaced apparat from one another.

Advantageously, lid 7 comprises at least a first gripping wall 20 and at least a second gripping wall 21. In particular, each one of first gripping wall 20 and second gripping wall 21 define a respective engagement surface configured to be engaged by a portion of an application device, the application device being adapted to arrange lid assembly 4 onto spout 3, and/or to align and/or to orient lid 7 during coupling and/or applying and/or arranging lid assembly 4 onto spout 3. In particular, first gripping wall 20 and second gripping wall 21 are configured to support alignment and/or orientation and/or rotation of lid 4 (by the application device).

Preferentially, first gripping wall 20 and second gripping wall 21 are opposed to one another (i.e. are arranged at opposite portions of lid 7).

In particular, first gripping wall 20 lies on a first plane H1 and second gripping wall 21 lies on a second plane H2. First plane H1 and second plane H2 being distinct from one another.

Preferentially, first plane H1 and second plane H2 are parallel to one another or in other words first gripping wall 20 and second gripping wall 21 are parallel to one another.

According to some preferred non-limiting embodiments, first plane H1 and second plane H2 are parallel to longitudinal axis E, in particular with lid 7 being controlled in the closed configuration.

In particular, first gripping wall 20 and second gripping wall 21 by lying within respectively first plane H1 and second plane H2, present straight portions, which are advantageous with respect to their gripping properties.

In particular, first gripping wall 20 and second gripping wall 21 are designed to be engaged by a gripping element of the application device.

By providing for first gripping wall 20 and second gripping wall 21, the application device is able to improve the control of the application of lid assembly 4 onto spout 3. In particular, it is easier to grip and to orient and/or to align lid assembly 4 with respect to spout 3 and/or package 2 and at the same time to reduce the risk of damaging lid assembly 4 and/or spout 3 and/or package 2.

According to the non-limiting embodiment disclosed in FIGS. 1 to 3, lifting portion 16 comprises first gripping wall 20 and second gripping wall 21.

Preferentially, first gripping wall 20 and second gripping wall 21 are transversal, in particular perpendicular, to elongated main wall 19. In particular, elongated main wall 19 is arranged on first gripping wall 20 and second gripping wall 21.

Preferentially, first gripping wall 20 and second gripping wall 21 are interposed between elongated main wall 19 and base frame 5 with lid assembly 4 being coupled to spout 3 and lid 7 being in the closed configuration.

Preferentially, first gripping wall 20 and second gripping wall 21 define respective lateral end walls of lifting portion 16.

In particular, first gripping wall 20 and second gripping wall 21 are connected to front section 15 and/or protrude from side wall 18.

According to some preferred non-limiting embodiments, lifting portion 16 further comprises one or more auxiliary walls 22 (only partially shown in FIGS. 1 and 3) interposed between first gripping wall 20 and second gripping wall 21.

Preferentially, auxiliary walls 22 are designed such to provide for an improved contact sensation of lifting portion 16 by a finger of the user.

Preferentially, auxiliary walls 22 are parallel to one another and to first gripping wall 20 and second gripping wall 21.

Preferentially, auxiliary walls 22 are connected to and protrude from front section 15 and/or side wall 18.

Preferentially, elongated main wall 19 is also arranged on auxiliary walls 22.

In particular, auxiliary walls 22 are interposed between elongated main wall 19 and base frame 5.

During the packaging process, coupling of lid assembly 4 to spout 3 requires coupling lid assembly 4 to a precursor of finalized package 1. In particular, the precursor of finalized package 1 comprises spout 3.

The precursor of finalized package 1 can be defined by the packaging material and spout 3 being connected to the packaging material. Alternatively, the precursor of finalized package 1 can be defined by package 2 carrying spout 3.

The coupling of lid assembly 4 to spout 3 comprises at least the steps of:

- in particular, providing the precursor of finalized package 1 together with spout 3;
- gripping lid assembly 4 at first gripping wall 20 and at second gripping wall 21;
- orienting and/or aligning lid assembly 4 with respect to the precursor of finalized package 1 and/or spout 3; and
- applying and/or arranging lid assembly 4 onto spout 3.

In particular, during the step of gripping, first gripping wall 20 and second gripping wall 21 are engaged by the gripping element of the application device and during the step of orienting and/or aligning the gripping element is controlled such to orient and/or to align lid assembly 4.

Preferentially, during the step of applying and/or arranging coupling ring 6 is arranged around the collar and lid 7 is arranged on spout 3 so as to cover the pouring outlet.

In use, outpouring of the pourable product from finalized package 1 requires to liberate and/or open the pouring outlet of spout 3. This is done by controlling lid 7 from the closed configuration to the open configuration.

The control from the closed configuration to the open configuration is done by the user engaging lifting portion 16 and exerting an opening force so as to angularly move lid 7 from the first angular position to the second angular position.

Preferentially, the first time lid 7 is to be controlled from the closed configuration to the open configuration coupling bridges 9 irreversibly rupture and the separation membrane become ruptured and/or opened and/or cut and/or removed and/or pierced.

It is repeatedly possible to close and open the pouring outlet by repeatedly moving lid 7 between the closed configuration and the open configuration.

Figure 4:
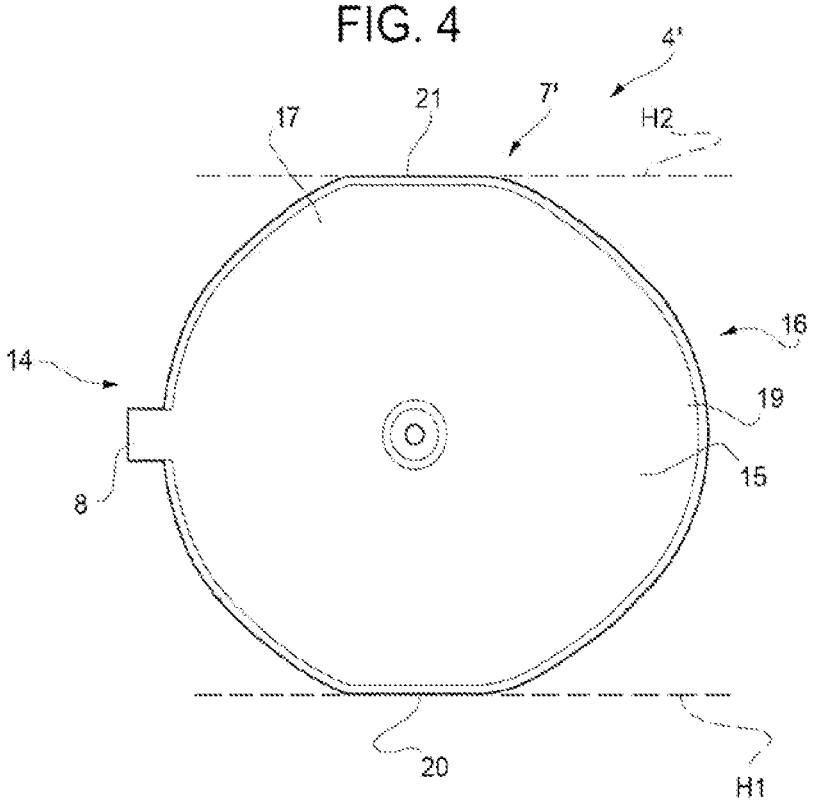
FIG. 4 is a top view of a lid assembly according to a second embodiment of the present invention, with parts removed for clarity.

With reference to FIG. 4, number 4' indicates an alternative embodiment of a lid assembly according to the present invention; as lid assembly 4' is similar to lid assembly 4, the following description is limited to the differences between them, and using the same references, where possible, for identical or corresponding parts.

In particular, lid assembly 4' differs from lid assembly 4 in comprising lid 7'; as lid 7' is similar to lid 7, the following description is limited to the differences between them, and using the same references, where possible, for identical or corresponding parts.

In particular, lid 7' differs from lid 7 in that main portion 14 comprises first gripping wall 20 and second gripping wall 21.

Preferentially, top wall 17 and/or side wall 18 comprise(s) first gripping wall 20 and second gripping wall 21.

In particular, according to the embodiment of FIG. 4, first gripping wall 20 and second gripping wall 21 are parallel to one another.

In particular, top wall 17 and/or side wall 18 comprise(s) respective linear and curved outer portions.

As the method of coupling lid assembly 4' to spout 3 is substantially identical to the method of coupling of lid assembly 4 to spout 3, we refer to the above-provided description.

As the use of finalized package 1 having lid assembly 4' is similar to the use of finalized package 1 having lid assembly 4, we refer to the above-provided description.

Figure 5:
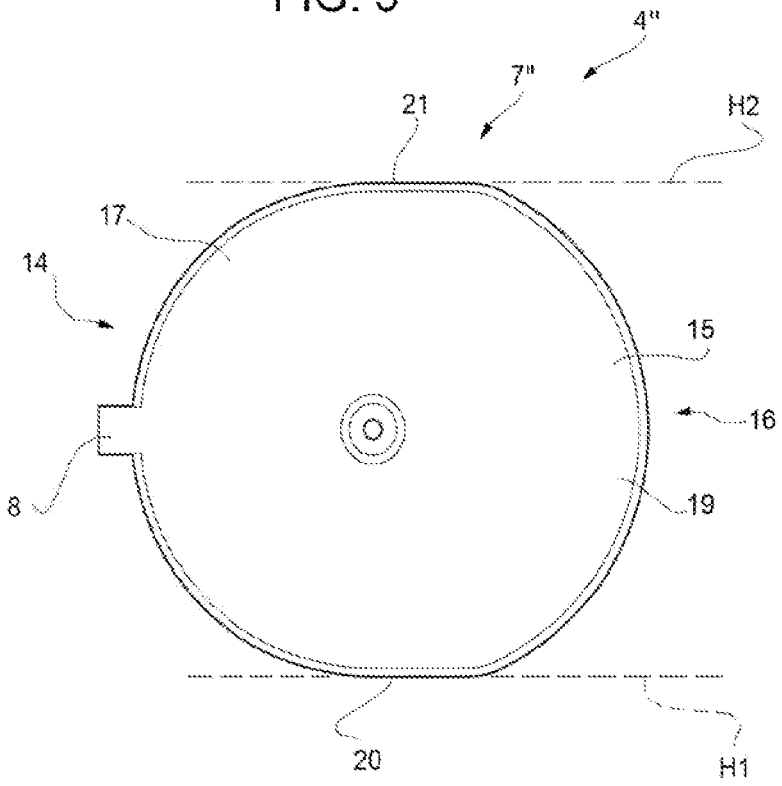
FIG. 5 is a top view of a lid assembly according to a third embodiment of the present invention, with parts removed for clarity.

With reference to FIG. 5, number 4" indicates an alternative embodiment of a lid assembly according to the present invention; as lid assembly 4" is similar to lid assembly 4', the following description is limited to the differences between them, and using the same references, where possible, for identical or corresponding parts.

In particular, lid assembly 4" differs from lid assembly 4' in comprising lid 7"; as lid 7" is similar to lid 7', the following description is limited to the differences between them, and using the same references, where possible, for identical or corresponding parts.

In particular, lid 7" differs from lid 7' in that first gripping wall 20 and second gripping wall 21 are not parallel to one another.

As the method of coupling lid assembly 4" to spout 3 is identical to the methods of coupling lid assembly 4' or lid assembly 4 to spout 3, we refer to the above-provided description.

As the use of finalized package 1 having lid assembly 4" is similar to the use of finalized package 1 having lid assembly 4 or lid assembly 4', we refer to the above-provided description.

The advantages of lid assembly 4, 4' or 4" and/or the finalized package 1 and/or the method of coupling lid assembly 4, 4' or 4" to spout 3 according to the present invention will be clear from the foregoing description.

In particular, by providing for first gripping wall 20 and second gripping wall 21 the overall handling of lid assemblies 4, 4' and 4" by means of the application device is facilitated. First gripping wall 20 and second gripping wall 21 allow to improve the gripping and the alignment and/or orientation of lid assembly 4, 4' and 4" and at the same time to reduce the risk of damaging lid assembly 4, 4' and 4" and/or finalized package 1 and/or package 2 and/or spout 3 during the application of lid assembly 4, 4' and 4".

Clearly, changes may be made to lid assembly 4, 4' and 4" and/or finalized package 1 and/or the method of coupling as described herein without, however, departing from the scope of protection as defined in the accompanying claims.

The invention claimed is:

1. Lid assembly for a container having a spout; the lid assembly comprises at least:

a coupling ring configured to be arranged around at least a portion of the spout;

a lid configured to selectively cover a pouring outlet of the spout; and a tethering element tethering the lid to the coupling ring;

wherein the lid comprises at least a top wall extending transversally to a central axis;

a side wall protruding from the top wall and extending transversally to the top wall, around the central axis;

a lifting portion having a main wall protruding from the top wall and extending parallel to the top wall; and a first gripping wall and a second gripping wall defining respective engagement surfaces configured to be engaged by at least a portion of an application device and/or to support gripping and/or alignment and/or rotation of the lid during a coupling of the lid assembly to the spout and being arranged on opposite portions of the lid;

wherein the first gripping wall and the second gripping wall protrude from the main wall along the side wall and are attached to the side wall, a portion of the side wall being interposed between the first gripping wall and the second gripping wall and being arranged below the main wall, wherein the first gripping wall is a planar wall that lies on a first plane and the second gripping wall is a planar wall that lies on a second plane distinct from the first plane; and wherein the first plane and the second plane are parallel to one another.

2. Lid assembly according to claim 1, wherein the lid is hinged to the coupling ring by means of the tethering element and is adapted to angularly move around a hinge axis defined by the tethering element; and wherein the tethering element is connected to the lid at a rear section of the lid.

3. Lid assembly according to claim 2, wherein the lid further comprises:

a main portion having the rear section and a front section opposite to the rear section; and the lifting portion protrudes from the front section and comprises the first gripping wall and the second gripping wall.

4. Lid assembly according to claim 3, wherein the first gripping wall and the second gripping wall define respective lateral end walls of the lifting portion.

5. Lid assembly according to claim 3, wherein the first gripping wall and the second gripping wall protrude from the side wall.

6. Lid assembly according to claim 1, wherein the lifting portion further comprises:

one or more auxiliary walls interposed between the first gripping wall and the second gripping wall; and the main wall is arranged on the first gripping wall, the second gripping wall and the auxiliary walls.

7. Lid assembly according to claim 6, wherein the auxiliary walls are parallel to the first gripping wall and the second gripping wall.

8. Lid assembly according to claim 1, wherein the lid assembly is controllable between at least a closed configuration in which the lid is configured to cover the pouring outlet and an open configuration in which the lid is configured to be or is detached from the pouring outlet.

9. Container for a pourable product comprising a spout having a pouring outlet and a lid assembly according to claim 1 and being coupled to the spout.

10. Container according to claim 9, wherein the coupling ring surrounds a collar of the spout and the lid is controllable between a closed configuration in which the lid covers the pouring outlet and an open configuration in which the lid opens the pouring outlet.

11. Method of coupling a lid assembly according to claim 1 to a spout having a pouring outlet;

the method comprising:

gripping the lid assembly at the first gripping wall and at the second gripping wall;

orienting and/or aligning the lid assembly with respect to a precursor of a container and/or the spout; and arranging and/or applying the lid assembly onto the spout.

12. Method according to claim 11, wherein during the arranging and/or applying, the coupling ring is arranged around a collar of the spout and the lid is arranged on the spout so as to cover the pouring outlet.

13. Lid assembly according to claim 1, wherein the shadowed portion of the side wall extends around the central axis from a first angular position to a second angular position, the first gripping wall being located at the first angular position and the second gripping wall being located at the second angular position.

14. Lid assembly according to claim 13, wherein the main wall of the lifting portion extends on a plane coplanar to the top wall of the lid, from the first angular position to the second angular position.

15. Lid assembly according to claim 13, wherein the side wall includes a further portion extending around the central axis from the second angular position to the first angular position and not being surmounted by the main wall of the lifting portion.

16. Lid assembly according to claim 1, wherein the side wall has a cylindrical shape extending continuously around the central axis.

* * * * *